US006068525A

United States Patent [19]

De Keyser

[11] Patent Number: 6,068,525

[45] **Date of Patent: *May 30, 2000**

[54] ELECTRICAL CONNECTOR FOR CONNECTING ELECTRICAL CONDUCTORS

[75] Inventor: Marcel L. De Keyser, Barcelona, Spain

[73] Assignee: Framatome Connectors International, Courbevoie, France

[ * ] Notice: This patent is subject to a terminal disclaimer.

[21] Appl. No.: 08/896,297

[22] Filed: May 16, 1997

[30] Foreign Application Priority Data

May 31, 1996 [ES] Spain ..... 9601202

[51] Int. Cl.[7] ..... H01R 4/50

[52] U.S. Cl. ..... 439/783; 439/393

[58] Field of Search ..... 439/783, 863, 439/790, 393, 425

[56] References Cited

U.S. PATENT DOCUMENTS

| | | | |
|---|---|---|---|
| 3,071,750 | 1/1963 | Heselwood | 439/863 |
| 3,848,956 | 11/1974 | Kraft . | |
| 4,650,273 | 3/1987 | Roosdrop | 439/783 |
| 5,244,422 | 9/1993 | Laricchia | 439/783 |
| 5,679,031 | 10/1997 | Chadbourne et al. | 439/783 |
| 5,842,893 | 12/1998 | De Keyser | 439/783 |

FOREIGN PATENT DOCUMENTS

| | | |
|---|---|---|
| 1 9102719A | 12/1993 | Brazil . |
| 2 065 994 | 7/1981 | United Kingdom . |

*Primary Examiner*—Khiem Nguyen
*Attorney, Agent, or Firm*—Perman & Green, LLP

[57] ABSTRACT

Electrical connector for connecting electrical conductors (12) having an insulating covering (14), which comprise: a receiver element (2) with two primary edges (8) in the shape of an arcute angle, with wings (10) emerging from each of said edges, which can partially enclose conductors (12); and a wedge element (4) provided with active edges (18) that form the same arcute angle; the wedge element (4) can be inserted between the primary edges (8) of element (2), comprises an electrically conductive material and its active edges (18) have external and opposing perforated means (20) suitable for piercing said electrical conductors (12) by perforating said insulating covering (14).

9 Claims, 2 Drawing Sheets

10
8
12
14
6
20
18
38
36
34
34
32
2
8
4
10
36
18
12
16
14

ELECTRICAL CONNECTOR FOR CONNECTING ELECTRICAL CONDUCTORS

BACKGROUND OF THE INVENTION

The invention pertains to an electrical connector for connecting electrical conductors provided with an insulating covering, said connector being suitable for assembling mechanically by means of any energy source and which comprises: [a] a receiving element that has two first edges that form a first uneven angle, from each one of which emerges a wing that is suitable for partially enclosing one of said conductors; and [b] a wedge element provided with active edges that form a second angle that is essentially equal to said first angle, said wedge element being suitable for inserting between said first edges of said receiver element.

REFERENCE TO THE PRIOR ART

Patent U.S. Pat. No. 3,848,956 describes a connector for obtaining an electrical branch from an underground conductor provided with an insulating covering, without the necessity for removing the insulation, and which provides a seal against moisture at the points where the two conductors are connected. However, the connector described is relatively difficult to install.

Also known are connectors that include a "C"-shaped sleeve and a wedge, such that the insertion of the wedge into the sleeve provides a fastener between the conductors that are to be connected, as well as an electrical connection between them, either through the sleeve or through the wedge. However, some of these connectors have disadvantages such as not being suitable for conductors with insulating covering, being difficult to assemble, and not maintaining a sufficiently secure connection.

SUMMARY OF THE INVENTION

The invention proposes to overcome the disadvantages described above. This goal is achieved with a connector of the type described in the beginning which is characterized in that said wedge element includes electrically conductive material and said active edges of said wedge element have outside and opposing perforating means suitable for piercing said electrical conductors by perforating said insulating covering.

BRIEF DESCRIPTIONS OF THE DRAWINGS

Other advantages and characteristics of the invention will become clear from the following description, wherein while it is not in any way limiting, the preferred embodiments of the invention are described, in relation to the attached drawings.

FIG. 1, an exploded perspective view of an embodiment of the connector that is the object of the invention, in relation to the two conductors between which a connection is intended to be established. Only a few sections of these conductors are illustrated.

FIG. 2, is a similar perspective front view of another embodiment of a connector according to the present invention.

DETAILED DESCRIPTION OF THE INVENTION

Figure 1:
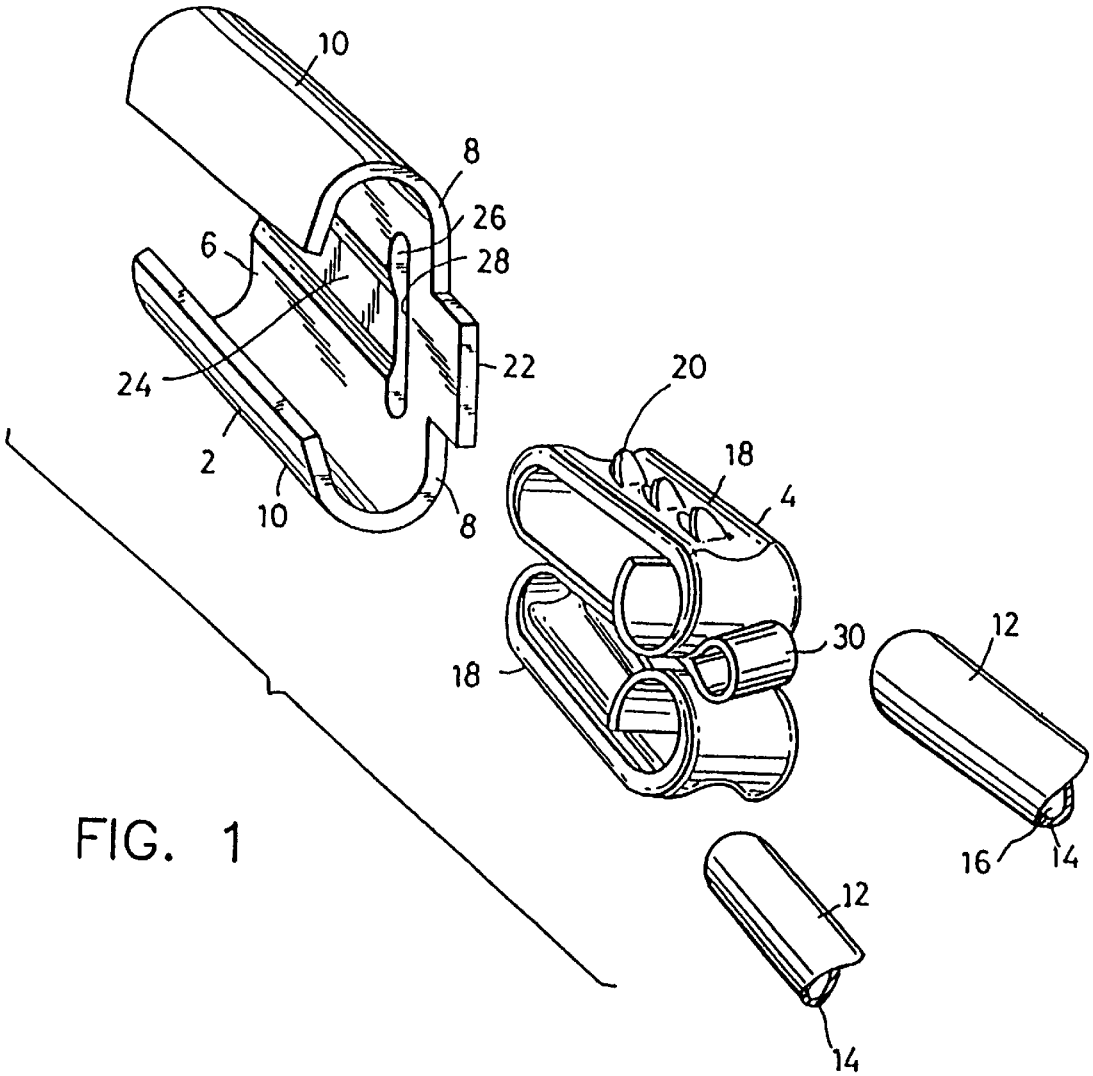

Although this invention will be described in relation to two embodiments, it should be understood that the characteristics of the invention may be embodied in other different ways. In addition, any dimensions, configurations or classes of suitable materials can be used.

The connector comprises a receiver element 2, and a wedge element 4. Receiver element 2 is "C"-shaped, which means that the transverse cross sections of receiver element 2 would reproduce the shape of this letter "C". Receiver element 2 consists of a central part or plate 6 that is limited in the longitudinal direction by two first edges 8 which form an uneven angle between them, that is, the first edges 8 are not parallel with one another. From each one of these first edges 8 emerges a wing 10 provided with a curvature or some bends which make them suitable so that each one of them can partially enclose one of conductors 12. Each one of these conductors 12 has an insulating covering 14 which surrounds the conductive core 16.

Wedge element 4 has two active edges 18 that form between them a second angle that is essentially equal to the first angle determined by first edges 8 of receiver element 2. This wedge element 4 can be inserted between wings 10 and it is preferable for the exterior surfaces of these active edges 18 to be concave, since it is intended for conductors 12 to be held firmly between them and the interior surfaces of wings 10.

In each one of active edges 18 there are perforating means 20, which can be in the form of a series of teeth (as shown in the figures), in the form of a lance or other perforating shape. When wedge element 4 is inserted with sufficient force between wings 10, which house these conductors 12, perforating means 20 pierce the insulating covering until contact is established with conductive core 16. Element 4 is made of an electrically conductive material, so that it ensures the passage of current between perforating means 20 located in the opposing active edges.

In the embodiment illustrated in FIG. 1, receiver element 2 has a posterior appendage 22, a depression 24 and a groove 26, which form an edge of end 28, and which, in a manner known in itself, facilitates retention of wedge element 4, ensuring correct functioning. For its part, wedge element 4 is formed by a single sheet of metal which has been deformed as shown, having been bent several times in the longitudinal direction, and including two principal bends that are essentially equal and a third bend 30. This configuration provides wedge element 4 with suitable elasticity.

Figure 2:
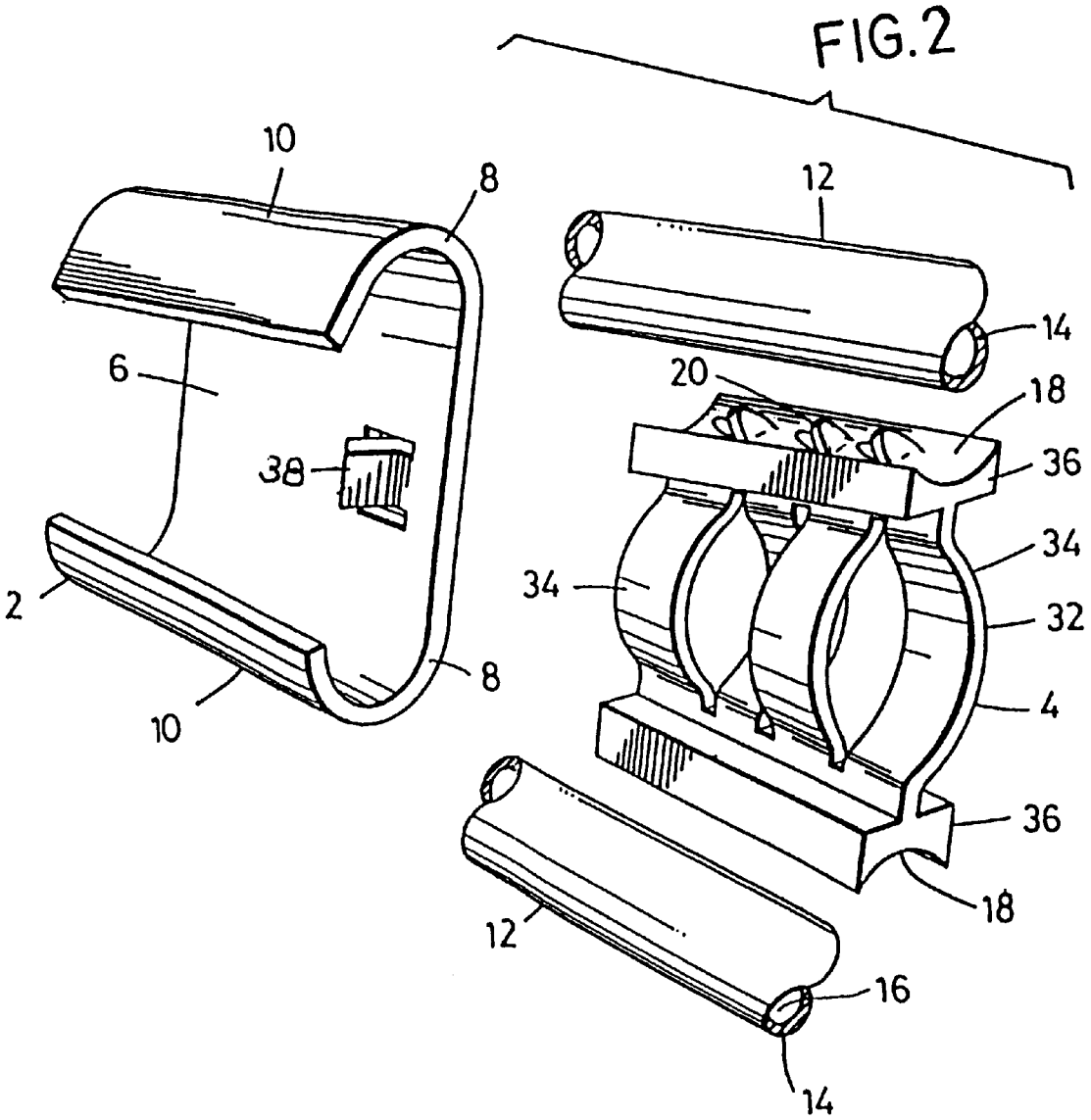

In the embodiment in FIG. 2, there is a central part in wedge element 4 which comprises a plurality of segments 34, curved outward and directed alternatively in opposite directions; these segments run between the end parts 36 in which active edges 18 are formed; this configuration also provides wedge element 4 with adequate elasticity. For its part, receiver element 2 has an appendage 38, which projects from the central part or plate 6 toward the interior of the space between wings 10; this appendage 38 is suitable for ensuring proper retention of wedge element 4, and also in this case, of ensuring correct functioning.

Any energy source is suitable for the mechanical assembly of the connector, such as of hydraulic origin, provided by a cartridge or other means. Obviously, in the case of small size connectors, they can be easily assembled simply using manual tools.

What is claimed:

1. Electrical connector for connecting electrical conductors (12) provided with insulating covering (14), said connector being suitable for being assembled mechanically by means of any power source and which comprises: a receiver element (2) which has two first edges (8) that form a first angle, from each one of which emerges a wing (10) suitable for partially enclosing one of said conductors (12); and a wedge element (4) provided with two active edges (18) which form a second angle that is essentially equal to said first angle, said wedge element (4) being suitable for inserting between said first edges (8) of said receiver element (3), characterized in that said wedge element (4) comprises an electrically conductive material and said active edges (18) of said wedge element (4) have external and opposing perforating means (20) for piercing said electrical conductors (12) by perforating said insulating covering (14).

2. Electrical connector according to claim 1, characterized in that said perforating means consist of a series of individual teeth (20).

3. Electrical connector according to claim 1, characterized in that said active edges (18) of said wedge element (4) define individual concavities each one of which can be applied to the outer surface of one of said conductors (12).

4. An electrical wedge connector comprising:

a receiver element; and a wedge element to be inserted into the receiver element and wedge two conductors against the receiver element on opposite sides of the wedge element, wherein at least one of the opposite sides of the wedge element comprises insulation perforating teeth aligned in a row one behind another along a majority of a longitudinal length of the wedge element, wherein the teeth are spaced from each other along the row, and wherein the teeth are electrically conductive.

5. A connector as in claim 4 wherein the teeth are provided on both of the opposite sides.

6. A connector as in claim 4 wherein the wedge element is comprised of a single deformed sheet metal member.

7. An electrical wedge connector comprising:

a receiver element; and a wedge element adapted to be inserted into the receiver element and wedge two conductors against the receiver element on opposite sides of the wedge element, wherein both of the opposite sides of the wedge element comprise insulation perforating teeth for piercing through insulation of the conductors and electrically connecting conductive cores of the conductors to each other through the teeth.

8. A connector as in claim 7 wherein the wedge element is comprised of a single deformed sheet metal member.

9. An electrical wedge connector comprising:

a receiver element; and a wedge element adapted to be inserted into the receiver element and wedge two conductors against the receiver element on opposite sides of the wedge element, wherein at least one of the opposite sides of the wedge element comprises insulation perforating teeth aligned in a row one behind another along a majority of a longitudinal length of the wedge element, wherein the teeth intersect a central plane of the wedge element passing through the opposite sides of the wedge element, and wherein the teeth are electrically conductive.

* * * * *